US005869783A

United States Patent [19]

Su et al.

[11] Patent Number: 5,869,783

[45] Date of Patent: Feb. 9, 1999

[54] METHOD AND APPARATUS FOR INTERACTIVE MUSIC ACCOMPANIMENT

[75] Inventors: Alvin Wen-Yu Su, Hwa-Tang Hsiang; Ching-Min Chang, Hsinchu; Liang-Chen Chien, Meisan Hsiang; Der-Jang Yu, Changhua, all of Taiwan

[73] Assignee: Industrial Technology Research Institute, Taiwan, Taiwan

[21] Appl. No.: 882,235

[22] Filed: Jun. 25, 1997

[51] Int. Cl.[6] ..... G10H 7/00

[52] U.S. Cl. ..... 84/612

[58] Field of Search ..... 84/612, 636, 645; 434/307 A

[56] References Cited

U.S. PATENT DOCUMENTS 5,140,887 8/1992 Chapman .
5,471,008 11/1995 Fujita et al. .
5,511,053 4/1996 Jae-Chang ..... 84/612 X
5,521,323 5/1996 Paulson et al. .
5,521,324 5/1996 Dannenberg et al. .
5,574,243 11/1996 Nakai et al. .
5,616,878 4/1997 Lee et al. .

*Primary Examiner*—William M. Shoop, Jr.
*Assistant Examiner*—Jeffrey W. Donels
*Attorney, Agent, or Firm*—Finnegan, Henderson, Farabow, Garrett & Dunner, L.L.P.

[57] ABSTRACT

A music accompaniment machine processes a music accompaniment file to alter a stored beat of the music accompaniment file to match a beat established by a user. The machine identifies the beat of the user using a voice analyzer. The voice analyzer isolates the user's singing signal from excess background noise and appends segment position information to the singing signal, which is indicative of the beat established by the singer. A MIDI controller alters the musical beat of the music accompaniment file so that it matches the beat established by the user.

19 Claims, 10 Drawing Sheets

METHOD AND APPARATUS FOR INTERACTIVE MUSIC ACCOMPANIMENT

BACKGROUND OF THE INVENTION

1. Field of the Invention

This invention relates generally to a musical accompaniment system and, more particularly, to a music accompaniment system that adjusts musical parameters in response to individual singers.

2. Description of the Related Art

A music accompaniment apparatus, commonly called a karaoke machine, reproduces a musical score or musical accompaniment of the song. This allows a user, or singer, to "sing" the lyrics of the song to the appropriate music. Typically, both the lyrics and the musical accompaniment are stored in the same medium. For example, FIG. 1 represents a conventional karaoke machine 100 comprising a laser disc player 102, a video signal generator 104, a video display 106, a music accompaniment signal generator 108, a speaker 110, a microphone 112, and a mixer 114. Karaoke machine 100 operates when the user inserts a laser disc 116, which contains a video, or lyric, signal (not shown) and an audio, or accompaniment, signal (not shown), into laser disc player 102. Video signal generator 104 extracts the video signal from laser disc 116 and displays the extracted video signal as the lyrics of the song on video display 106. Accompaniment signal generator 108 extracts the audio signal from laser disc 116 and sends it to mixer 114. Substantially simultaneously, a singer sings the lyrics displayed on video display 104 into microphone 112, which transforms the singing into an electrical singing signal 118 indicative of the singing. Electrical signal 118 is sent to mixer 114. Mixer 114 combines the audio signal and electrical singing signal 118 and outputs a combined acoustic signal 120 to speaker 110, which produces music.

Karaoke machine 100, however, simply produces a faithful reproduction of the stored music accompaniment, including a beat. The beat is defined as the musical time as indicated by regular recurrence of primary accents in the singing or the music accompaniment. This forces the user or singer to coordinate with the fixed or pre-stored parameters of the music accompaniment stored on the laser disc (or some other acceptable medium, such as, for example, a memory of a personal computer). If the singer does not keep pace with the fixed beat, then he will not be synchronous with the musical accompaniment. The singer must, therefore, adjust his beat to accommodate the fixed beat of the stored music. Therefore, it would be desirable to adjust parameters of the stored music to accommodate the singing style of the singer.

SUMMARY OF THE INVENTION

The advantages and purpose of this invention will be set forth in part from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, systems consistent with the present invention process music accompaniment files based on a beat established by a user. A method for processing music accompaniment files consistent with the present invention comprises steps, performed by a processor, of selecting a music accompaniment file for processing and converting a sound with a characteristic beat into an electrical signal indicative of the characteristic beat. The process alters a musical beat of the music accompaniment file to match the characteristic beat indicated by the electrical signal and outputs the electrical signal and the music accompaniment file.

An apparatus for processing music accompaniment files stored in a memory consistent with the present invention comprises a first controller to extract the music accompaniment file from the memory that corresponds to a selection and a microphone to convert a sound with a characteristic beat into an electrical signal. An analyzer to filter the electrical signal and identify the characteristic beat so that a second controller can match a musical beat of a music accompaniment file to the characteristic beat.

A computer program product consistent with the present invention includes a computer usable medium having computer readable code embodied therein for processing data in a musical instrument digital interface (MIDI) controller, the computer usable medium comprises a selecting module configured to select a music accompaniment file in a MIDI format to be processed by a first controller and an analyzing module configured to convert external sound with a characteristic beat into an electrical signal indicative of the characteristic beat. A control process module is configured to accelerate or decelerate a musical beat of the music accompaniment file to match the characteristic beat.

BRIEF DESCRIPTION OF THE DRAWINGS

The accompanying drawings which are incorporated in and constitute a part of this specification, illustrate preferred embodiments of the invention and, together with the description, explain the goals, advantages and principles of the invention. In the drawings.

DESCRIPTION OF THE PREFERRED EMBODIMENT

Reference will now be made in detail to the present preferred embodiments of the invention, examples of which are illustrated in the accompanying drawings. It is intended that all matter contained in the description below or shown in the accompanying drawings shall be interpreted as illustrative and not in a limiting sense.

Methods and apparatus in accordance with this invention are capable of altering the beat of a musical accompaniment so that the beat of the musical accompaniment matches the natural beat of a singer. The alteration is performed primarily by detecting the time it takes the singer to sing portions of the songs (for example, the time it takes to sing one word) and comparing that time to a preprogrammed standard time to sing that portion. Based on the comparison, a music accompaniment machine, for example, adjusts the beat of the musical accompaniment to match the beat of the singer.

Figure 1:
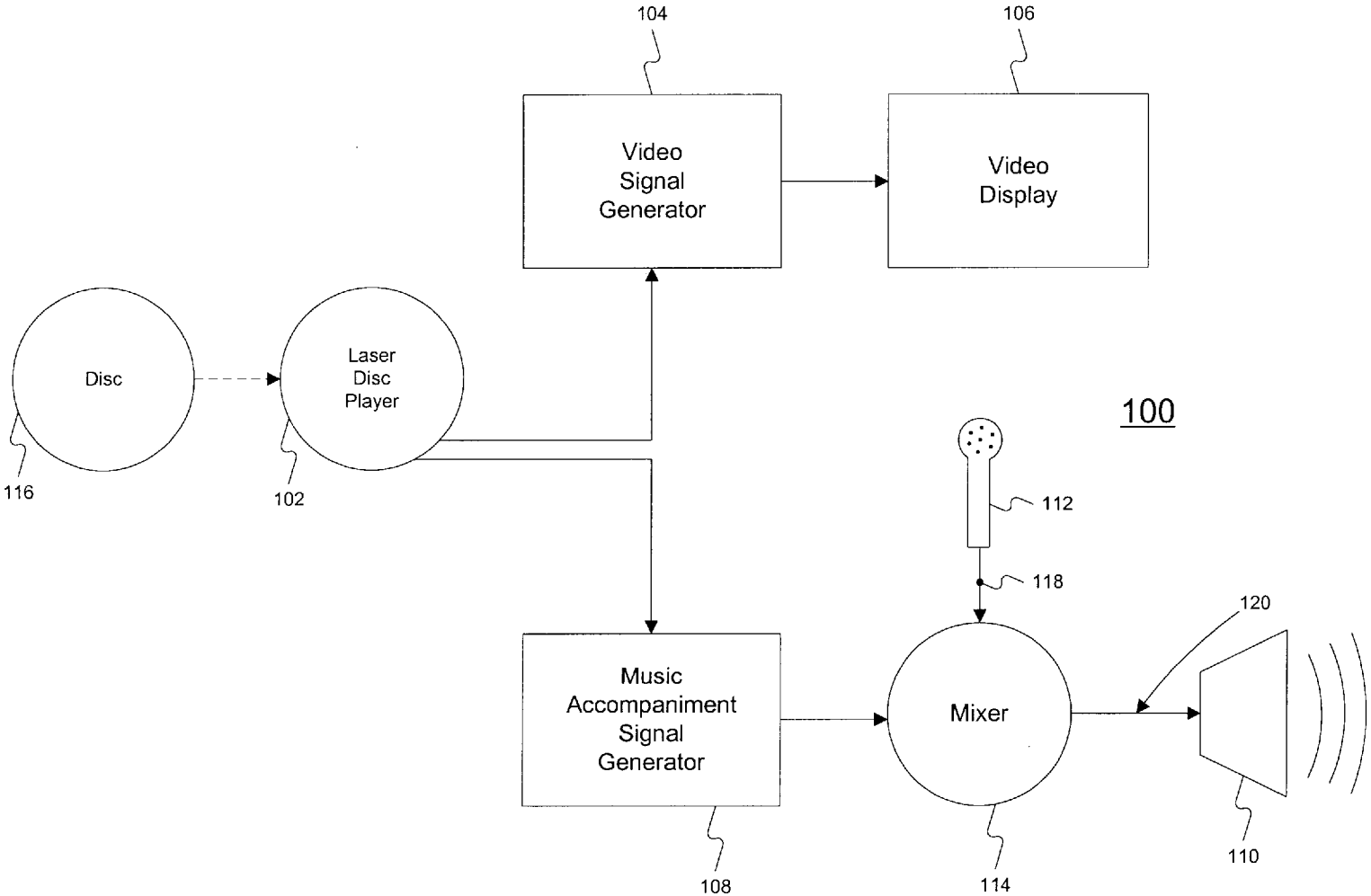
FIG. 1 is a diagrammatic representation of a conventional karaoke machine.
Figure 2:
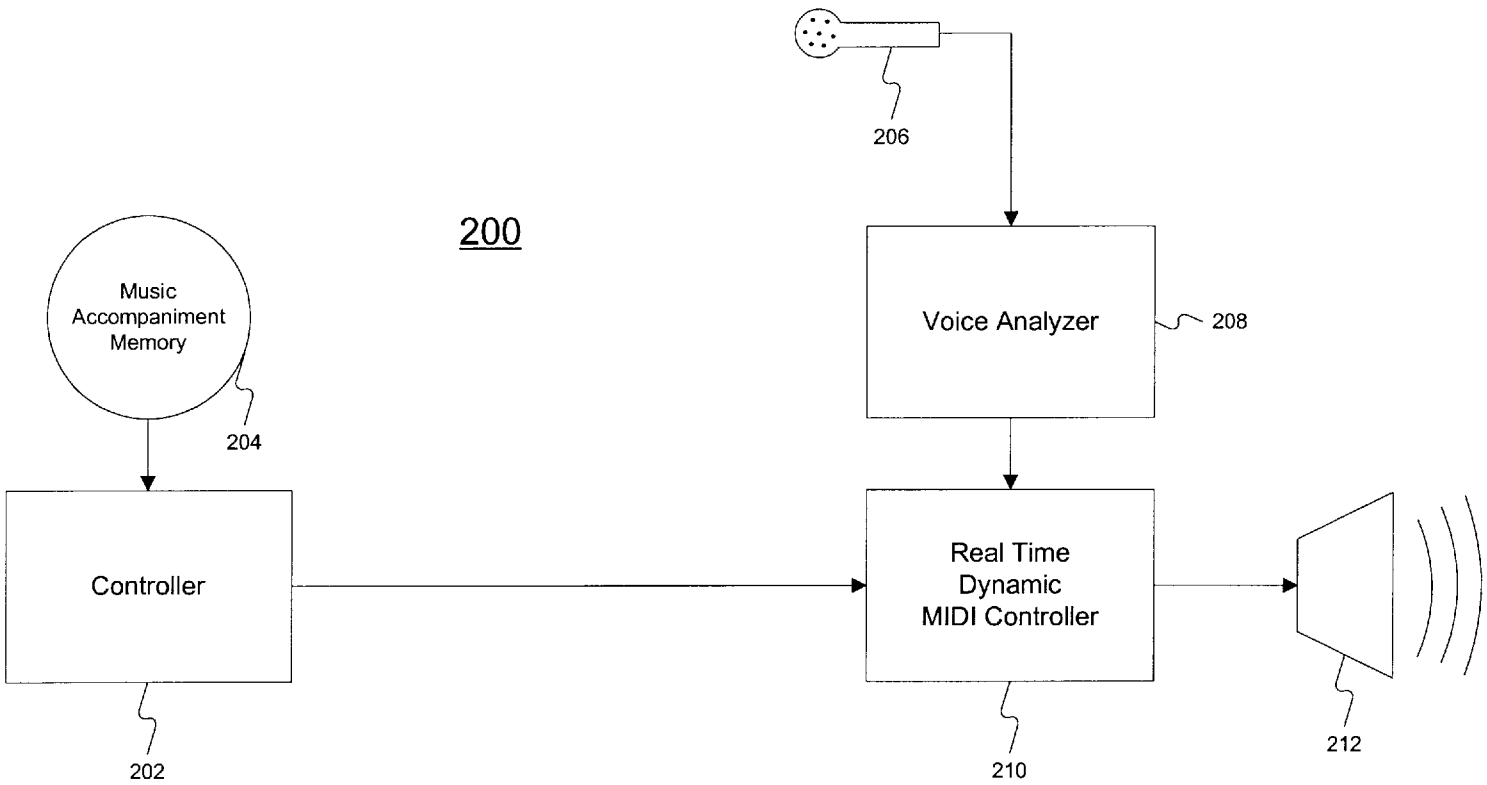
FIG. 2 is a diagrammatic representation of a music accompaniment system consistent with the present invention.

FIG. 2 represents a musical accompaniment system 200 constructed in accordance with the present invention. Musical accompaniment system 200 includes a controller 202, a music accompaniment memory 204, a microphone 206, a voice analyzer 208, a real time dynamic MIDI controller 210, and a speaker 212.

In the preferred embodiment music accompaniment memory 204 resides in a portion of ROM of a personal computer random access memory ("RAM") of a personal computer, or some equivalent memory medium. The configuration of controller 202 could be a personal computer, and depends, to some degree, on the medium of music accompaniment memory 204. While it is possible for a person of skill in the art to construct hardware embodiments of the devices of music accompaniment system 200 in accordance with the teachings herein, in the preferred embodiment the devices are encompassed by software modules installed on the personal computer hosting controller 202.

Figure 3:
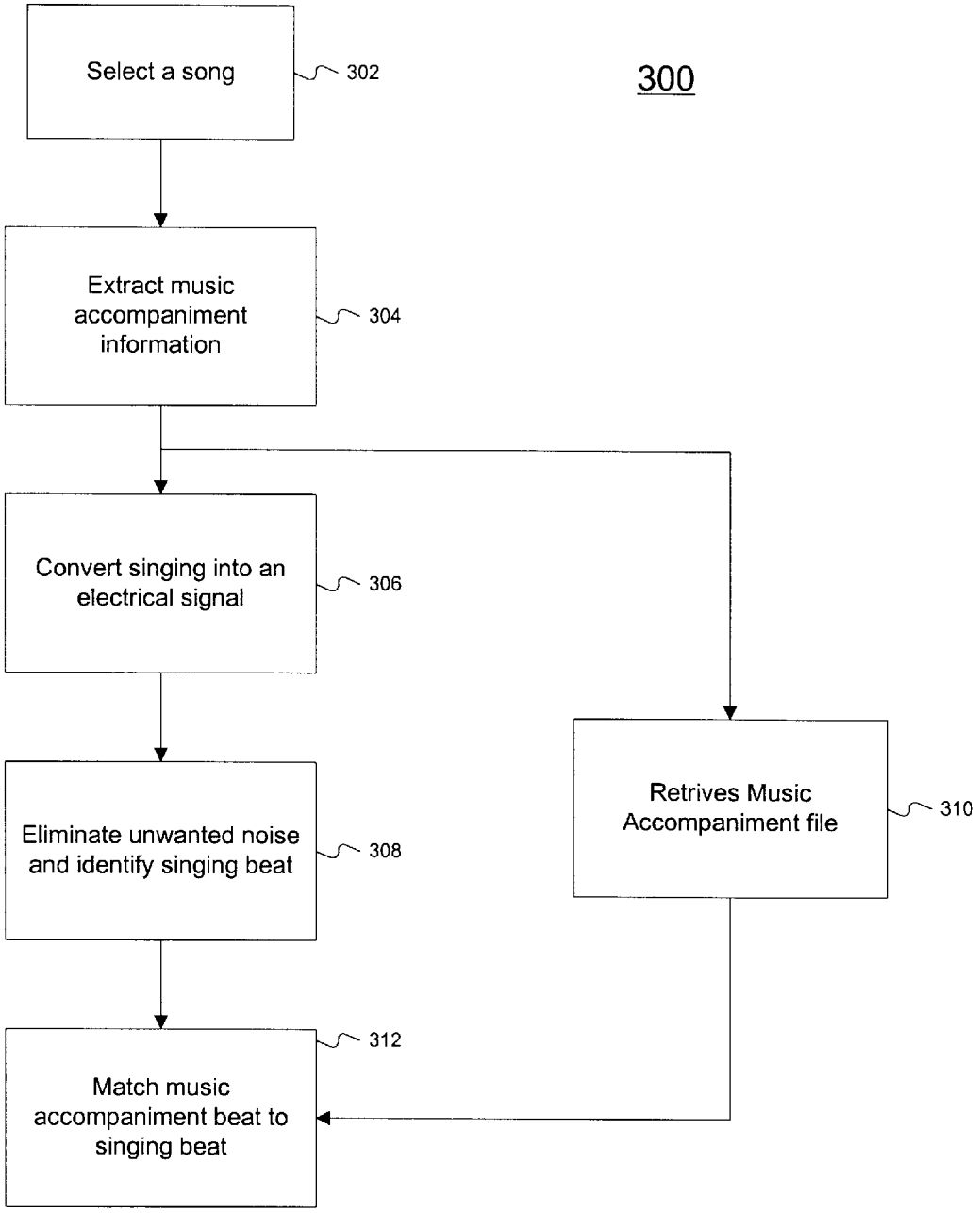
FIG. 3 is a flow chart illustrating a method for processing accompaniment music consistent with the present invention.

FIG. 3 is a flow chart 300 illustrating the operation of musical accompaniment system 200. First, a singer selects a song (step 302). Based on this selection controller 202 extracts a pre-stored file containing music accompaniment information stored in a MIDI format from music accompaniment memory 204 and causes the file to be stored in memory accessible by MIDI controller 210 (step 304). For example, controller 202 extracts a selected music accompaniment information file from a plurality of music accompaniment information files stored in the ROM of a host personal computer (music accompaniment memory 204) and stores the music accompaniment information in the RAM (not shown) of the host personal computer. The RAM could be associated with either controller 202 or MIDI controller 210. The singer sings the associated lyrics of the selected music accompaniment into microphone 206. Microphone 206 converts the singing into an electrical signal that is supplied to voice analyzer 208 (step 306).

The electrical signal outputted from microphone 206 contains unwanted background noise, such as noise from speaker 212. To eliminate the unwanted noise, voice analyzer 208, as explained in more detail below, filters the electrical signal (step 308). Additionally, voice analyzer 208 segments the electrical signal to identify a beat of the singer's singing. MIDI controller 210 retrieves the music accompaniment information file from the accessible memory (step 310). Step 310 occurs substantially simultaneously and in parallel with steps 306 and 308. Real time dynamic MIDI controller 210 uses the identified beat of the singing to alter the parameters of the music accompaniment signal so that the beat of the music accompaniment signal matches the beat of the singing signal (step 312). The accompaniment MIDI file for the selected song is completely pre-stored in for example the RAM of a host personal computer and can be accessed in real time by MIDI controller 210 during playback. Thus the change in beat does not interfere with music transmission. In other words, the change in the beat does not cause music flow problems.

Figure 4:
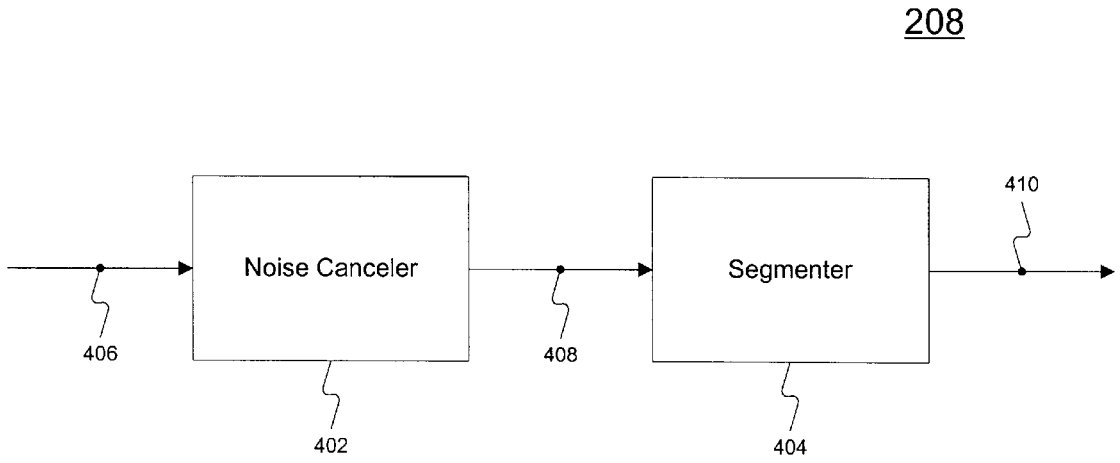
FIG. 4 is a diagrammatic representation of a voice analyzer shown in FIG. 2.

In order to match the beat of the music to that of the singer, apparatus consistent with the present invention functions to determine the beat at which the singer is singing. FIG. 4 illustrates a construction of voice analyzer 208 capable of determining the beat of the singer. Voice analyzer 208 functions to determine the natural beat of the singer singing the song and includes a noise canceler 402 to isolate the sound of the singer's voice from other unwanted background noise, and a segmenter 404 to determine the time for the singer to sing a portion, e.g., word of the song.

Noise canceler 402 functions to filter out unwanted sounds so that only the singing of the singer is used to determine the beat. The unwanted sound cancellation is necessary because a receiver, such as microphone 206, can pick up noise generated not just by the singer, but also by other sources, such as, for example, left and right channel speakers of music accompaniment system 200, which are typically positioned in close proximity to the singer. A noisy singing signal 406 is processed by noise canceler 402. After the processing noise canceler 402 outputs an estimated singing signal 408. Estimated singing signal 408 is used by segmenter 404 to determine the beat of the singer's singing. Segmenter 404 outputs segment position information indicative of the natural beat of the singer's singing that is appended to estimated singing signal 408. Estimated singing signal 408 with the appended segment position information is identified on FIG. 4 as segment position estimated singing signal 410.

Figure 5:
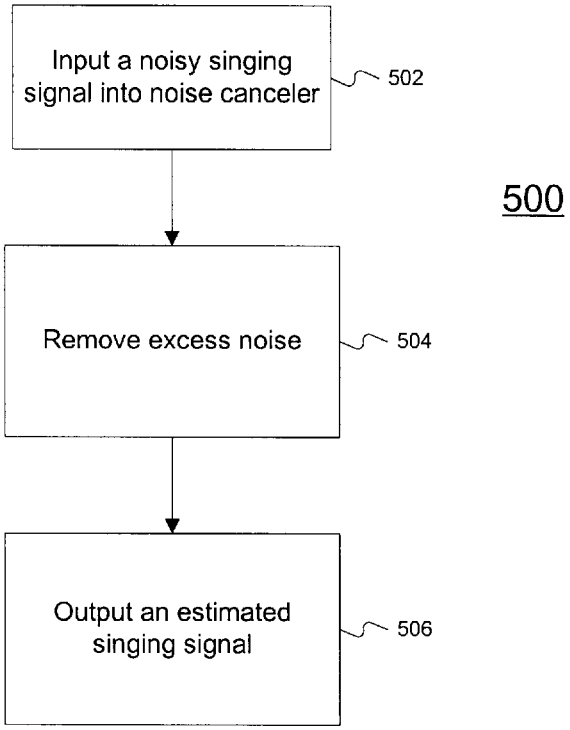
FIG. 5 is a flow chart illustrating a method for canceling excess noise such as performed by a noise canceler shown in FIG. 4.

FIG. 5 is a flow chart 500 illustrating the operation of noise canceler 402. First, noisy singing signal 406 is inputted into noise canceler 402 (step 502). Noisy singing signal 406, includes an actual singing signal, represented by $S^A[n]$, left speaker channel noise, and right speaker channel noise, where the total noise signal received by microphone 206 is represented by $n_0[n]$. Where the point [n] is some point along a time axis. This combined sound can be represented by:

$$S^O[n]=S^A[n]+n_0[n] \quad \text{(Equation 1)}$$

Next, noise canceler 402 removes the excess noise (step 504). If, for example, it is assumed that the unwanted signals emitted as left speaker channel noise and right speaker channel noise can be represented as $n_1[n]$ ($n_1[n]$ signal is equal to the actual noise produced by the speakers at the origination point (the speaker), whereas $n_0[n]$ signal equals the speaker noise at the microphone i.e. after the noise travels over a path between the speaker and the microphone, which includes, inter alia, attenuation of the speaker noise over the path length, then the excess sound that is part of noisy singing signal 406 can be represented by:

$$y[n]=\Sigma h[i]n_1[n-i] \quad \text{(Equation 2)}$$

where i=0 to N−1 (N for equation 2 and 5 is the length of the adaptive digital filter), and $$H[z]=Z\{h[n]\} \quad \text{(Equation 3)}$$

where equation 3 represents the estimated parameters of noise canceler 402. Function h[i] represents the change in the speaker noise over the path from the origination point of the noise, for example the speaker, to the microphone. Thus, h[i] represents the filter effect of the path and h[n] represents the filter within the convolution process. Both h[i] and h[n] are defined in accordance with signal processing theory as known by one of ordinary skill in the art. After the excess sound is removed by noise canceler 402, it outputs estimated singing signal 408 represented by $S^e[n]$, where $S^e[n]=S^O[n]-y[n]$, which is an estimation of the singing of the singer without the excess noise. The error between actual singing and estimated singing signal 408 is defined as e[n] such that:

$$e^2[n]=(S^A[n]-S^e[n])^2 \quad \text{(Equation 4).}$$

The design of noise canceler 402 is based on the desired minimum error between the actual singing and estimated singing signal 408. The error is represented as e[n]. The parameters of noise canceler 402 can be obtained by iteratively solving:

$$h[i]^{n+1}=h[i]^n+\eta(\{e[n]\cdot n_1[n]\}/\|n_1[n]\|) \quad \text{(Equation 5)}$$

for i equals 0 to N−1, and $0<\eta<2$, until the error is minimized. The values n and n+1 denote the iterations of the solution process. The term η is a system learning parameter preset by the system designer. This allows estimated singing signal 408 ($S^e[n]$) to be outputted to segmenter 404 (step 506).

Figure 6:
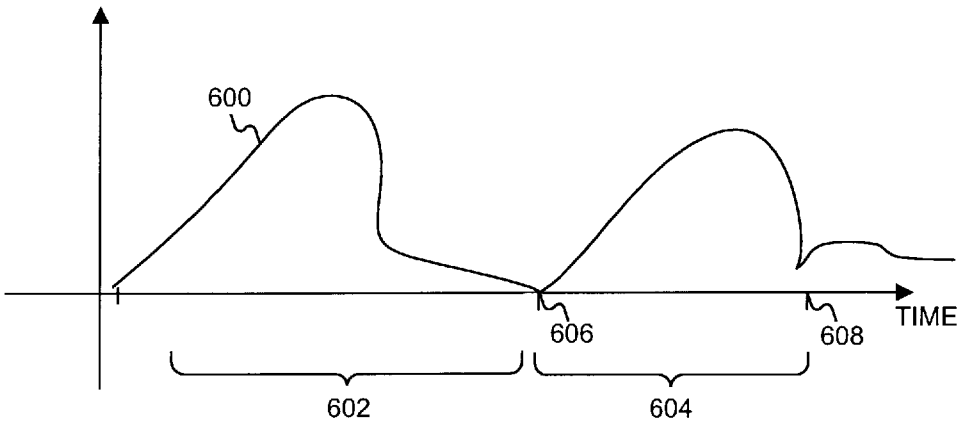
FIG. 6 is a graphical representation of a typical wave contour that may be inputted into the voice analyzer.

Segmenter 404 functions to distinguish the position of each lyric sung on a time axis. For example, FIG. 6 is a representation of a possible singing wave contour 600. Wave contour 600 includes lyrics 602, 604 etc. Lyric 604, for example, begins at a first position 606, which corresponds to a termination position of lyric 602, and terminates at a second position 608, which corresponds to the beginning position of the next lyric (not shown). Segmenter 404 can determine the first and second positions 606 and 608 of each lyric on a time axis using several different methods. For example, two such known methods including an energy envelope method and a non-linear signal vector analysis can be used.

Figure 7:
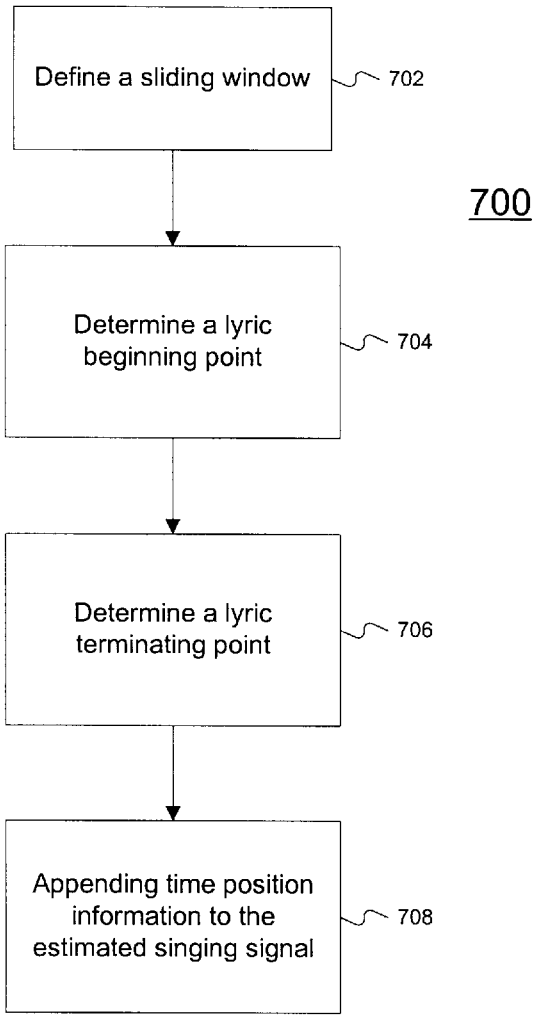
FIG. 7 is a flow chart illustrating one method of segmenting an estimated singing en signal consistent with the present invention.

FIG. 7 is a flow chart 700 representing the function of segmenter 404 using the energy envelope method. As wave contour 600 indicates, lyrics 602, 604, etc., are continuous. These words are separated into segments by a boundary zone, which is that area in the immediate vicinity of first and second positions 606 and 608 that has a marked fall in energy level followed by a rise in energy. Thus, the segmentation positions can be determined by examining the changes in energy. Assuming wave contour 600 can be represented by x[n], where x[n] is equivalent to $S^A[n]$, then the segmentation positions can be determined by the procedure outlined in flow chart 700. First using estimated singing signal 408, a sliding window W[n] is defined with a length of 2N+1 as follows (step 702):

$$W[n]=\begin{cases}0 & \text{for } n \leqq -N\\ 1 & \text{for } -N \leqq n \leqq N\\ 0 & \text{for } n \geqq N\end{cases} \quad \text{(Equation 6)}$$

where N (for equations 6–8) is a time value preset by the system designer. Thus, the energy for a particular point in time can be defined as:

$$E[n]=[1/(2N+1)]\Sigma|W[i]\cdot x[n-1]|, \text{ for } i=-N \text{ to } +N \quad \text{(Equation 7)}$$

Next, the first position 606 of a segment is determined when the energy signal increases above a predetermined threshold (step 704). In other words, lyric 604 begins at a point n when equation 7 is greater than a predetermined threshold. A segment position is determined to exist when $T_1\cdot(E[n+d])$ is less than or equal to E[n] and E[n+d] is less than or equal to $T_2\cdot(E[n+2d])$. $T_1$ and $T_2$ are constants between 0 and 1, and d is an interval preset by the system designer. $T_1$, $T_2$, and d are predetermined for the song. The segment position is outputted to real time dynamic MIDI controller 210. The time position information is appended to the estimated singing signal and outputted from segmenter 404 as time position estimated singing signal 410 (step 708).

Figure 8:
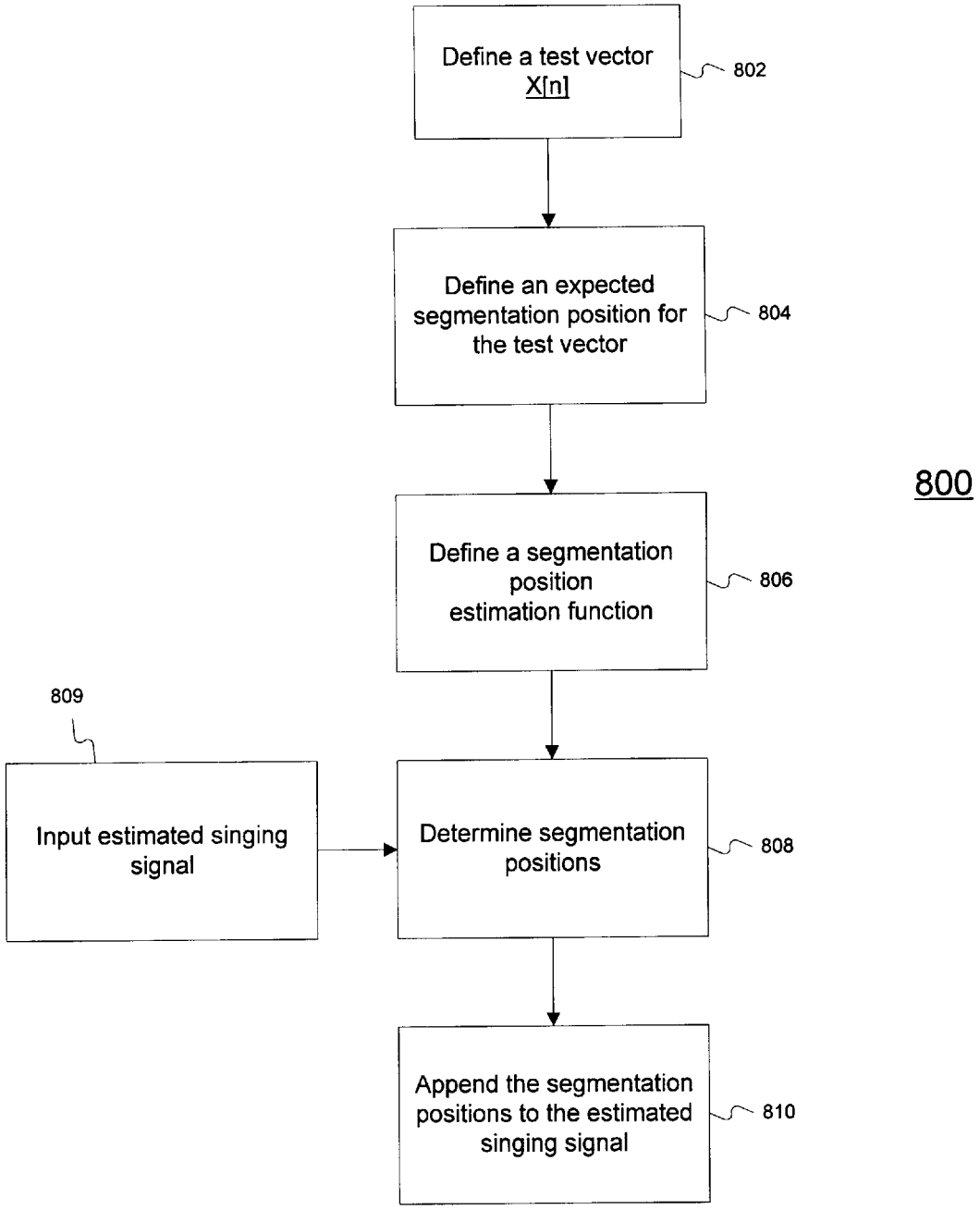
FIG. 8 is a flow chart illustrating another method of segmenting an estimated singing signal consistent with the present invention.

FIG. 8 is a flow chart 800 representative of determining segment positions using a non-linear signal vector analysis. First using pre-recorded test singing signals x[n], a vector is defined as (step 802):

$$X[n]=\{x[n], x[n+1], \ldots, x[n-N], x[n]\cdot x[n], x[n]\cdot x[n-1], \ldots, x[n-N]\cdot x[n-N]\}^T \quad \text{(Equation 8)}$$

X[n] is a vector consisting of singing signals. T represents the transpose of the vector. Next, a segmentation characteristic is defined as (Step 804):

$$Z[n]=\begin{cases}1 & \text{for a segmentation position}\\ 0 & \text{for a non-segmentation position}\end{cases}. \quad \text{(Equation 9)}$$

Next, an estimation function is defined as (Step 806):

$$e_x[n]=\alpha^T\cdot X[n] \quad \text{(Equation 10)}$$

where $e_x[n]$ is an estimator of the segment position and $\alpha^T$ is a constant vector. T represents the transpose of the vector. A cost function is defined as:

$$\Im[n]=E\{(e_x[n]-Z[n])^2\} \quad \text{(Equation 11)}$$

where E represents the expectation value of the function in its associated brackets. For more information regarding expectation value functions see A. Papoulis, *Probability, Random, Variables, and Statistical Process*, McGraw-Hill 1984. $\Im[n]$ is minimized using the Wiener-Hopf formula such that:

$$\alpha=R^{-1}\beta. \quad \text{(Equation 12)}$$

$$R=E\{X[n]\cdot X^T[n]\} \text{ and } \beta=\{Z[n]\cdot X[n]\} \quad \text{(Equation 13).}$$

For more information regarding the Wiener-Hopf formula, see N. Kalouptisidis et al., *Adaptive System Identification and Signal Processing Algorithms*, Prentice-Hall 1993. Different singers singing different songs are recorded as training data for obtaining α, β, and R. The segmentation positions Z[n] for the signals described above are determined first by a programmer. Equations 12 and 13 are used to calculate α. After α has been obtained equation 10 is used to calculate the estimation function $e_x[n]$. Segmentation positions can then be defined as:

$$\text{segmentation position} = \begin{cases} \text{yes} & \text{for } |e_{\Delta}[n] - 1| \leqq \epsilon \\ \text{no} & \text{otherwise} \end{cases} \quad \text{(Equation 14)}$$

where $\epsilon$ is a confidence index (step 808). In conjunction with step 808 the estimated singing signal is input (step 809). The segmentation position is appended to the estimated singing signal and outputted to real time dynamic MIDI controller 210 (step 810).

In summary, the non-linear signal vector analysis uses a number of pre-recorded test singing signals that are arranged using equation 8, to obtain the vector X[n]. A human listener first identifies the segment positions for the test signals and obtains Z[n] values. By using equation 12 and equation 13, $\alpha$, $\beta$, and R are calculated. Once $\alpha$, $\beta$, and R are calculated, the segment positions of the singing signal can be determined using equation 11 and equation 14. The segment positions identified by voice analyzer 208 are used by real time dynamic MIDI controller 210 to accelerate, positively or negatively, the accompaniment music stored in memory accessible by MIDI controller 210.

Preferably, the music accompaniment information is stored in music accompaniment memory 204 in a MIDI format. If, however, the music accompaniment information is not in a MIDI format, a MIDI converter (not shown) would be necessary to convert the music accompaniment signal into a MIDI compatible format prior to storing the music accompaniment information into the memory that is accessible by MIDI controller 210.

Figure 9:
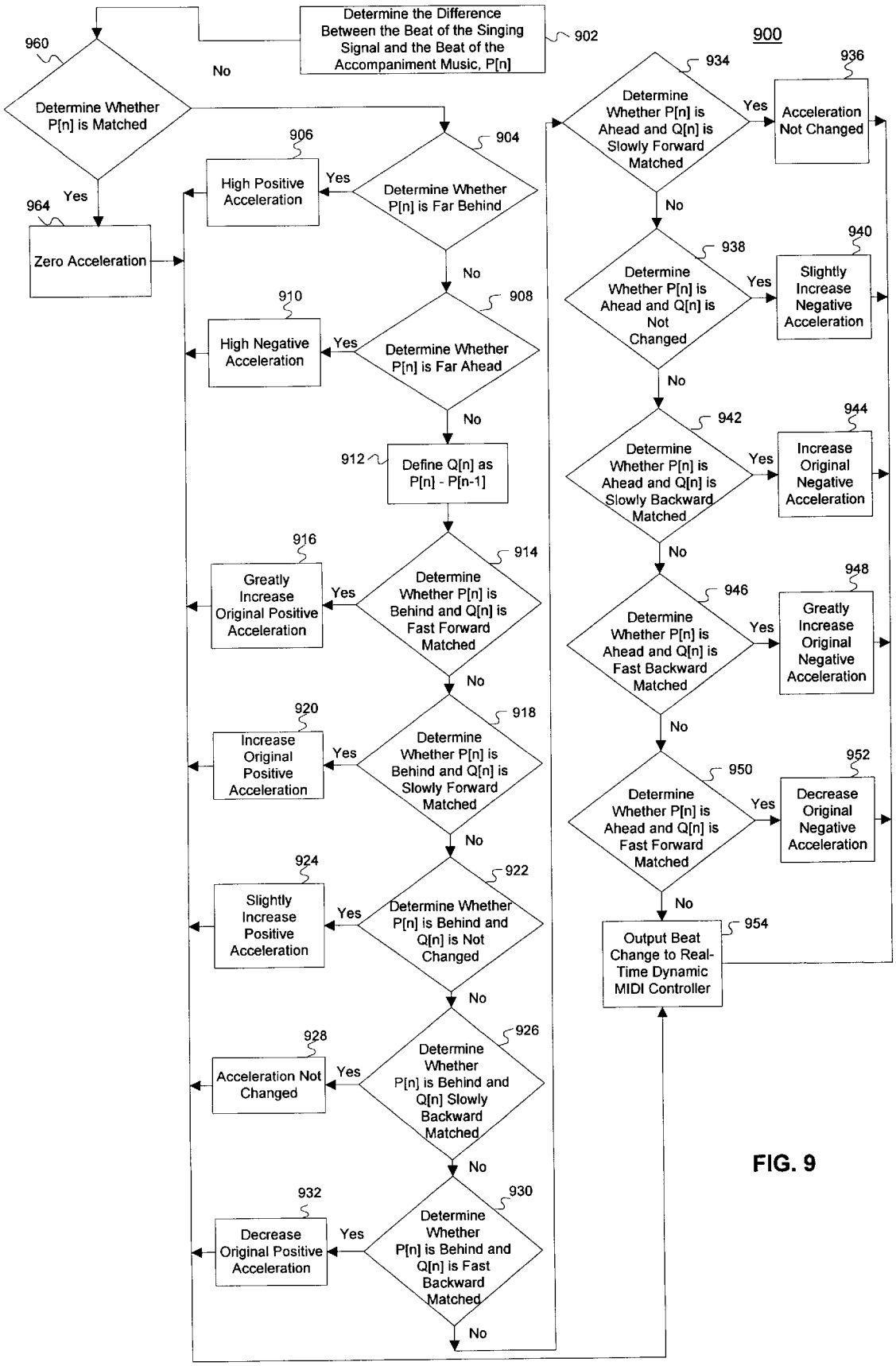
FIG. 9 is a flow chart illustrating a fuzzy logic operation of altering the beat of the music accompaniment signal consistent with the present invention.
Figure 10:
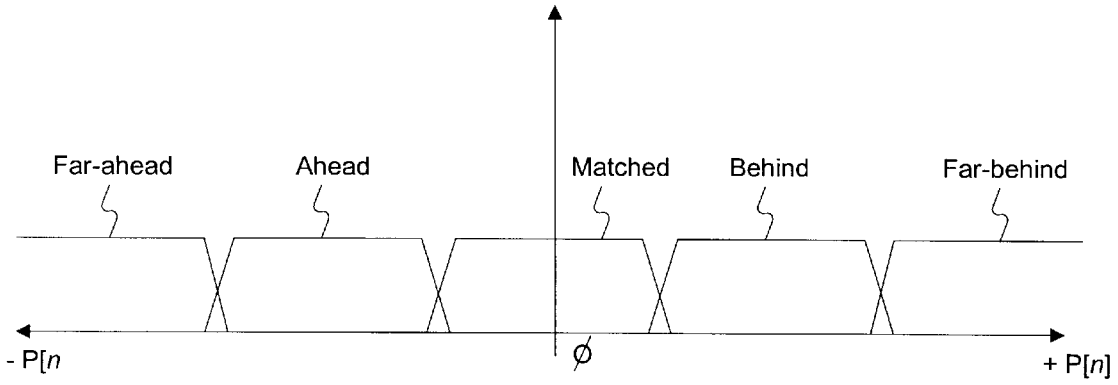
FIG. 10 is a graphical plot of a fuzzy logic membership function for the determination of whether the accompaniment signals are matched with the segment positions, in accordance with FIG. 9.
Figure 11:
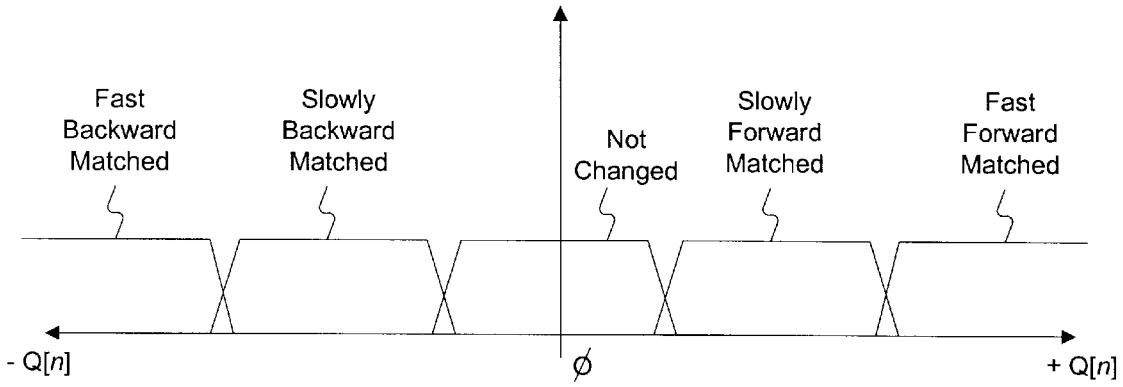
FIG. 11 is a graphical plot of a fuzzy logic membership function for the determination about whether the acceleration is sufficient in accordance with FIG. 9.

Real Time Dynamic Midi Controller 210 is described more fully in co-pending application of Alvin Wen-Yu SU et al. for METHOD AND APPARATUS FOR REAL-TIME DYNAMIC MIDI CONTROL Ser. No. 08/882,736 filed the same date as the present application, which disclosure is incorporated herein by reference. Specifically, the converted MIDI signal and the music accompaniment signal are inputted into a software control subroutine. The software control subroutine uses a fuzzy logic control principle to accelerate, positively or negatively, a beat of the music accompaniment signal so that it matches the beat of the converted singing signal. FIG. 9 is a flow chart 900 illustrating how the software control subroutine adjusts the beat. First P[n] is defined as the difference between the beat of the singing signal and the beat of the accompaniment music (step 902). FIG. 10 represents the fuzzy sets designed for the signal P[n]. The software control subroutine determines which fuzzy set P[n] belongs to. For example the software control subroutine determines whether P[n) is matched (step 960). If P[n] is matched then the acceleration is zero (step 964). It also determines whether P[n] is far-behind (step 904). If P[n] is far-behind then the music accompaniment signal receives high positive acceleration (step 906), otherwise it is further determined whether P[n] is far-ahead (step 908). If P[n] is far-ahead then the music accompaniment signal receives high negative acceleration (step 910). If P[n] is not far-behind or far-ahead, Q[n] is defined as P[n]–P[n–1], and (step 912). FIG. 11 represents the fuzzy sets designed for the signals Q[n]. Next, the software control subroutine determines whether P[n] is behind and Q[n] is fast forward matched (step 914). If P[n] is behind and Q[n] is fast forward matched, then the original positive acceleration is greatly increased (step 916). Otherwise, it is further determined whether P[n] is behind and Q[n] is slowly forward matched (step 918). If P[n] is behind and Q[n] is slowly forward matched, then the original positive acceleration is increased (step 920). Otherwise, it is further determined whether P[n] is behind and Q[n] is not changed (step 922). If P[n] is behind and Q[n] is not changed then original acceleration is slightly increased (step 924). Otherwise, it is further determined whether P[n] is behind and Q[n] is slowly backward matched (step 926). If P[n] is behind and Q[n] is slowly backward matched, then the acceleration is not changed (step 928). Otherwise, it is further determined whether P[n] is behind and Q[n] is fast backward matched (step 930). If P[n] is behind and Q[n] is fast backward matched, then the original positive acceleration is decreased (step 932). Otherwise it is further determined whether P[n] is ahead and Q[n] is slowly forward matched (step 934). If P[n] is ahead and Q[n] is slowly forward matched then the original negative acceleration is not changed (step 936). Otherwise it is further determined whether P[n] is ahead and Q[n] is not changed (step 938). If P[n] is ahead and Q[n] is not changed then the original negative acceleration is increased slightly (step 940). Otherwise it is further determined whether P[n] is ahead and Q[n] is slowly backward matched (step 942). If P[n] is ahead and Q[n] is slowly backward matched then the original negative acceleration is increased (step 944). Otherwise it is further determined whether P[n] is ahead and Q[n] is fast backward matched (step 946). If Pin] is ahead and Q[n] is fast backward matched, then the original negative acceleration is greatly increased (step 948). Otherwise, it is determined whether P[n] is ahead and Q[n] is fast forward matched (step 950). If P[n] is ahead and Q[n] is fast forward matched, then the original negative acceleration is decreased (step 952). Once the beats associated with the music accompaniment signal and the converted MIDI signal have matched, the beat change is is outputted to MIDI controller 210, which plays the music (step 954).

While the above disclosure is directed to altering a music accompaniment file based upon a beat of a singer, it can be used on any external signal, such as, for example, a musical instrument, speaking, and sounds in nature. The only requirement is that the external signal have either an identifiable beat or identifiable segment positions.

It will be apparent to those skilled in the art that various modifications and variations can be made in the method of the present invention and in construction of the preferred embodiments without departing from the scope or spirit of the invention. Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for processing music accompaniment files comprising steps, performed by a processor, of:

selecting a music accompaniment file for processing;

converting a sound with a characteristic beat into an electrical signal indicative of the characteristic beat;

filtering the electrical signal to eliminate unwanted background noise:

segmenting the filtered signal to identify the beat:

altering a musical beat of the music accompaniment file to match the characteristic beat indicated by the electrical signal;

outputting the electrical signal and the music accompaniment file.

2. An apparatus for processing music accompaniment files stored in a memory comprising:

a first controller to extract the music accompaniment file from the memory that corresponds to a selection;

a microphone to convert a sound with a characteristic beat into an electrical signal;

an analyzer to filter the electrical signal and identify the characteristic beat;

a second controller to match a musical beat of a music accompaniment file to the characteristic beat.

3. A computer program product comprising:

a computer usable medium having computer readable code embodied therein for processing data in a musical instrument digital interface (MIDI) controller, the computer usable medium comprising:

a selecting module configured to select a music accompaniment file in a MIDI format to be processed by a first controller;

an analyzing module configured to convert external sound with a characteristic beat into an electrical signal indicative of the characteristic beat; and a control process module configured to accelerate a musical beat of the music accompaniment file to match the characteristic beat.

4. A method for processing music accompaniment files, comprising the steps, performed by a processor, of:

selecting a music accompaniment file for processing;

converting a song sung by a singer into an electrical singing signal indicative of a singing beat, wherein the step of converting comprises:

filtering the electrical singing signal to eliminate unwanted background noise; and segmenting the filtered signal to identify the singing beat;

altering a musical beat of the music accompaniment file to match the singing beat indicated by the electrical singing signal; and outputting the electrical singing signal and the music accompaniment file as a song.

5. A method in accordance with claim 4 wherein the step of filtering comprises:

estimating the unwanted background noise based on a path of the background noise between an origination of the background noise and a microphone;

filtering the electrical singing signal based on the estimated background noise; and outputting an estimated singing signal based on the filtered electrical singing signal.

6. A method in accordance with claim 5 wherein the step of generating the filter includes establishing a learning parameter to minimize an error between an actual singing portion of the electrical singing signal and the estimated singing signal.

7. A method in accordance with claim 4 wherein the step of segmenting comprises:

measuring energy of the filtered signal:

identifying a beginning position when the measured energy increases above a predefined threshold; and identifying a termination position when the measured energy decreases below a predefined threshold.

8. A method in accordance with claim 4 wherein the step of segmenting comprises:

prestoring test singing signals;

generating a vector estimator using the pre-stored test singing signals;

defining vector segmentation positions based on the test signals;

calculating an estimation function based on the vector estimator and vector segmentation positions such that a cost function is minimized;

determining actual segmentation positions based on the estimation function being within a confidence index.

9. A method in accordance with claim 4 wherein the step of altering a musical beat includes accelerating the beat of the music accompaniment file.

10. A method for processing music accompaniment files, comprising the steps, performed by a processor, of:

selecting a music accompaniment file for processing;

converting a song sung by a singer into an electrical singing signal indicative of a singing beat;

altering a musical beat of the music accompaniment file to match the singing beat indicated by the electrical singing signal, wherein the step of altering a musical beat includes accelerating the beat of the music accompaniment file, and wherein the step of accelerating comprises:

segmenting the electrical singing signal into segment positions to identify the singing beat;

determining the segment positions; and determining the acceleration necessary to cause the music accompaniment file to coincide with the segment position; and outputting the electrical singing signal and the music accompaniment file as a song.

11. A method in accordance with claim 10 wherein the step of determining includes determining whether the segment position is one of far-ahead of the music accompaniment file, ahead of the music accompaniment file, behind the music accompaniment file, far-behind the music accompaniment file, and matched with the music accompaniment file.

12. A method in accordance with claim 11 wherein the segment position determining step comprises:

calculating a difference between the segment position and an immediately preceding segment position when it is determined that the segment position is one of ahead of the music accompaniment file, behind the music accompaniment file and matched with the music accompaniment file.

13. An apparatus for processing music accompaniment files stored in a memory, comprising:

a first controller to extract the music accompaniment file from the memory that corresponds to a musical selection of a user, wherein the music accompaniment file is in a MIDI format;

a microphone to convert singing of the user into an electrical signal;

a voice analyzer to filter the electrical signal and identify a singing beat; and a second controller for matching a musical beat of a music accompaniment file to the signing beat.

14. An apparatus for processing music accompaniment files stored in a memory, comprising:

a first controller to extract the music accompaniment file from the memory that corresponds to a musical selection of a user;

a microphone to convert singing of the user into an electrical signal;

a voice analyzer to filter the electrical signal and identify a singing beat, wherein the voice analyzer comprises:

a noise canceler to eliminate unwanted background noise from the electrical signal; and a segmenter to identify the singing beat; and a second controller for matching a musical beat of a music accompaniment file to the signing beat.

15. An apparatus for processing music accompaniment files stored in a memory, comprising:

means for selecting a music accompaniment file;

means for extracting the music accompaniment file from memory;

means for converting singing of the user into an electrical signal;

means for identifying a singing beat of the electrical signal; and means for altering a musical beat of the music accompaniment file to match the singing beat.

16. The apparatus of claim 15 wherein the means for altering the musical beat of the music accompaniment file includes means for accelerating the musical beat.

17. An apparatus for processing music accompaniment files stored in a memory based on an electrical signal indicative of singing of a user, comprising:

a voice analyzer including:

means for filtering the electrical signal to eliminate unwanted background noise; and means for segmenting the filtered signal to identify the singing beat; and a controller for matching a musical beat of a music accompaniment file to the singing beat.

18. The apparatus in accordance with claim 17 wherein the controller includes means for accelerating the musical beat to match the singing beat.

19. A computer program product comprising:

a computer usable medium having computer readable code embodied therein for processing data in a musical instrument digital interface (MIDI) controller, the computer usable medium comprising:

a selecting module configured to select a music accompaniment file to be processed by the MIDI controller;

an analyzing module configured to convert singing by a user into an electrical signal indicative of a singing beat; and a control process module configured to accelerate a musical beat of the music accompaniment file to match the singing beat.

* * * * *